US007523925B2

(12) United States Patent
Herbert et al.

(10) Patent No.: US 7,523,925 B2
(45) Date of Patent: Apr. 28, 2009

(54) DEVICE FOR TRANSMITTING AND CONVEYING A STRIP OF MATERIAL AND METHOD FOR REGULATING THESE DEVICES

(75) Inventors: Burkard Otto Herbert, Würzburg (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 171 days.

(21) Appl. No.: 10/540,209

(22) PCT Filed: Dec. 3, 2003

(86) PCT No.: PCT/DE03/03972

§ 371 (c)(1),
(2), (4) Date: May 24, 2006

(87) PCT Pub. No.: WO2004/056686

PCT Pub. Date: Jul. 8, 2004

(65) Prior Publication Data

US 2007/0194169 A1 Aug. 23, 2007

(30) Foreign Application Priority Data

Dec. 18, 2002 (DE) ..... 102 59 681
Mar. 27, 2003 (DE) ..... 103 13 774

(51) Int. Cl.
*B41F 13/54* (2006.01)

(52) U.S. Cl. ..... 270/5.02; 270/4; 270/5.01; 270/5.03; 270/8; 270/9; 270/12; 270/15; 270/16; 270/17; 270/20.1; 270/21.1; 270/52.07; 270/52.08; 270/52.09; 270/52.11; 270/41; 270/43; 270/44

(58) Field of Classification Search ..... 270/4, 270/5.01, 5.02, 5.03, 8, 9, 12, 15, 16, 17, 270/20.1, 21.1, 52.07, 52.08, 52.09, 52.11, 270/41, 43, 44
See application file for complete search history.

(56) References Cited

U.S. PATENT DOCUMENTS 2,871,011 A 1/1959 Hercik (Continued)

FOREIGN PATENT DOCUMENTS

DE 668 877 12/1938

(Continued)

OTHER PUBLICATIONS

Newspaper Techniques—Sep. 1991—"Six-Wide Newspaper Presses—History and Facts".

(Continued)

*Primary Examiner*—Gene Crawford
*Assistant Examiner*—Leslie A Nicholson, III
(74) *Attorney, Agent, or Firm*—Jones, Tullar & Cooper, P.C.

(57) ABSTRACT

A device is used for at least one of treating and conveying a strip of material in one of a treating and processing machine. The device includes at least one strip-treating tool which is embodied in the form of a folding cone, and one strip-treating tool which is provided as a knife. The knife and the folding cone are both transversely displaceable in the direction of travel of the strip of material by the operation of a regulating element.

21 Claims, 14 Drawing Sheets

U.S. PATENT DOCUMENTS

| | | | | | |
|---|---|---|---|---|---|
| 3,734,487 | A | * | 5/1973 | Treff | 270/52.08 |
| 3,808,768 | A | * | 5/1974 | Dobbs | 53/460 |
| 4,725,050 | A | | 2/1988 | Fujishiro | |
| 4,795,451 | A | * | 1/1989 | Buckley | 604/385.26 |
| 4,848,632 | A | | 7/1989 | Mack et al. | |
| 5,230,501 | A | * | 7/1993 | Melton | 270/41 |
| 5,263,414 | A | * | 11/1993 | Lehrrieder et al. | 101/228 |
| 5,328,437 | A | * | 7/1994 | Maylander et al. | 493/357 |
| 5,357,859 | A | | 10/1994 | Eckert | |
| 5,379,211 | A | * | 1/1995 | McVenes | 700/124 |
| 5,707,054 | A | * | 1/1998 | Loquet et al. | 270/6 |
| 5,855,336 | A | | 1/1999 | Inoue et al. | |
| 6,024,684 | A | | 2/2000 | Maylander et al. | |
| 6,139,003 | A | * | 10/2000 | Michalik et al. | 270/52.17 |
| 6,358,192 | B1 | * | 3/2002 | Michalik | 493/424 |
| 6,422,552 | B1 | | 7/2002 | Chesno et al. | |
| 6,695,250 | B2 | | 2/2004 | Michalik et al. | |
| 6,712,749 | B1 | | 3/2004 | Michalik et al. | |
| 6,820,839 | B2 | | 11/2004 | Weis | |
| 2002/0184986 | A1 | | 12/2002 | Oehmen et al. | |
| 2003/0071162 | A1 | | 4/2003 | Moser | |
| 2004/0159251 | A1 | | 8/2004 | Theilacker | |

FOREIGN PATENT DOCUMENTS

| | | | |
|---|---|---|---|
| DE | 3614981 | C2 | 4/1988 |
| DE | 3533274 | C3 | 11/1990 |
| DE | 4204254 | A1 | 8/1993 |
| DE | 4311437 | A1 | 2/1994 |
| DE | 19540164 | C1 | 2/1997 |
| DE | 19602248 | A1 | 7/1997 |
| DE | 10003025 | C1 | 5/2001 |
| DE | 10022964 | A1 | 10/2001 |
| DE | 10150810 | A1 | 4/2003 |
| EP | 0457304 | A1 | 5/1991 |
| EP | 1 106 554 A 2 | | 6/2001 |
| EP | 1238935 | A2 | 2/2002 |
| EP | 1415944 | A1 | 10/2003 |
| GB | 2171084 | | 8/1986 |
| WO | WO 01/70608 | A1 | 9/2001 |

OTHER PUBLICATIONS

Newspaper Techniques—Oct. 1991—"KBA Journal, a "Little Sister" for the Commander and Express".
No Author Listed, "Rotations—Tiefdruckmaschinen fur den Zeitschriftendruck", Cerutti.
No Author Listed, "Rotations- Tiefdruckmaschinen fur Verpackungsmaterialien," Cerutti.
No Author Listed, "Tiefdruck, Tiefdruck-Rotationsmaschinen fur die Herstellung von Magazinen, Katalogen und Prospekten," Koenig & Bauer-Albert.
No Author Listed, "Albert-Frankenthal Seileinzugssystem Automatischer Bahneinzug vom Abroller bis zum Uberbau,".
No Author Listed, "Edizione 1990," Mario Cotta.
No Author Listed, ""Falzapparate Albert-Tiefdruckrotationen"," Albert-Frankenthal.
No Author Listed, ""Tiefdruck Rotationen", " Albert Frankenthal.
No Author Listed, ""TR65-Anlage"; "TR6B-Anlagen"; "TR4 S-Anlage", ".
No Author Listed, ""Albert-Aladin Mikrocomputersystem fur Tiefdruck", " Albert-Frankenthal.
No Author Listed, ""Tiefdruckwerke Albert-Tiefdruckrotationen", " Albert-Frankenthal.
No Author Listed, ""Magazinuberbau System Rapid Albert-Tiefdruckrotationen", " Albert-Frankenthal.
No Author Listed, ""Albert Frankenthal Gravure Rotaries", " Albert Frankenthal.
No Author Listed , "Photo of Albert TR5S,".
No Author Listed, ""Double Reel Stands Albert Gravure Rotaries", " Albert-Frankenthal.
No Author Listed, ""Albert Proof Printing Gravure Rotaries", " Albert-Frankenthal.
No Author Listed, ""Automatic Rope-type Webbing System Albert Gravure Rotarties", " Albert-Frankenthal.
No Author Listed, ""Albert Gravure Printing", " Albert-Frankenthal.
No Author Listed, ""Press Configurations—Albert Gravure Rotarties", " Albert-Frankenthal.
No Author Listed, ""Albert Aladin—Micro-computer System for Gravure Printing", " Albert-Frankenthal.
No Author Listed, ""Gravure Printing Units Albert Gravure Rotaries", " Albert-Frankenthal.
No Author Listed, ""Magazine Super-structure, "Rapid" system Albert Gravure Rotaries", " Albert-Frankenthal.
No Author Listed, ""Folder-Albert Gravure Rotaries", " Albert-Frankenthal.
No Author Listed, ""Gravure Printing, Gravure Printing Machines for the production of magazines, catalogues and brochures", " Koenig & Bauer-Albert.
No Author Listed, ""Gravure Rotary TR 7 B/308 Magazine production from start to finish", ".
No Author Listed, ""Installation Planning Perfection in detail, Efficient use of Gravure Rotaries in line with environmental protection", ".
No Author Listed, ""Reel Stand Model DRE with electric drive", ".
No Author Listed, ""Robotic forme cylinder exchange technology, Albert-Frankenthal Gravure Technology, Always a step ahead", ".
No Author Listed, ""Harmonic-Drive draw roller drive Stable with extremely fine regulation", ".
No Author Listed, ""Double-width folders-up to 6 deliveries, Folder technology, High Tech from Albert-Frankenthal", ".
No Author Listed, ""Aladin production data aquisition", ".
No Author Listed, "Proof Printing Machine with Sheeter, Proof Prinitng Machine CT 7,".
Wolfgang Walenski, ""Der Rollen Offset druck, Geschichte Moderne Technik Materialien", " Fachschriften-Verlag.
Helmut Kipphan Handbuch der Printmedien-Technologien und Produktionsverfahren; ISBN 3-540-66941-8 Springer Verlag Berlin Heidelberg New York (German).

* cited by examiner

DEVICE FOR TRANSMITTING AND CONVEYING A STRIP OF MATERIAL AND METHOD FOR REGULATING THESE DEVICES

CROSS-REFERENCE TO RELATED APPLICATIONS

This application is the U.S. national phase, under 35 USC 371, of PCT/DE2003/003972, filed Dec. 3, 2003; published as WO 2004/056686 A1 on Jul. 8, 2004 and claiming priority to DE 102 59 681.6, filed Dec. 18, 2002 and to DE 103 13 774.2 filed Mar. 27, 2003, the disclosures of which are expressly incorporated herein by reference.

FIELD OF THE INVENTION

The present invention is directed to devices for processing and/or conveying a web, as well as to methods for their regulation. At least one web processing tool is movable by an actuating member transversely to a running direction of the web of material.

BACKGROUND OF THE INVENTION

A device for longitudinally cutting foils and tapes is known from EP 1 238 935 A2. An upper cutter can be positioned transversely to the transport direction of the web for setting a cutting width.

A roll changer is known from DE 101 50 810 A1. Two roll arms form a pair of arms for receiving a roll, each of which arms can be individually moved by its own motor along an axis of rotation of the roll.

DE 196 02 248 A1 discloses a former. For the lateral control of the folded continuous web, the former can be moved along an inlet gap between two downstream located rollers.

A turning bar, which can be positioned transversely to the incoming direction of the web, and a register roller, which can be positioned along the incoming direction of the web, are known from WO 01/70608. The turning bar is pivotable in such a way that it provides directional changes toward either the right or the left, depending on its position.

DE 36 14 981 C2 discloses two web edge sensors, each of which has a drive mechanism. Both drive mechanisms are controlled by a common control device. DE 35 33 274 C3 discloses a similar device.

A transport device with two side-by-side arranged conveying devices for endless material, is shown in DE 195 40 164 C1. Each device has an axially movable advancement arrangement.

An arrangement, by the use of which it is possible to cut two partial webs or three partial webs of variable width out of a running paper web of maximum width and to fold these partial webs, is known from DE 42 04 254 A1. The arrangement disclosed there includes three formers which are arranged at two levels. Two formers, which adjoin each other at a first level, are arranged to be displaceable transversely to the running direction of the paper web in order to be selectively used for folding both partial webs of a paper web which was divided into two partial webs, or for folding the two outer partial webs of a paper web which divided into three partial webs. A matching of other web-conducting devices, except for the formers, to the respective web width is not provided.

A turning bar arrangement is known from DE 43 11 437 A1. Turning bars can be shifted to displace a web, which has been turned by them over its width, toward the left or the right, depending on the position of the turning bars. This turning bar arrangement cannot be easily combined with the arrangement of DE 42 04 254 A1, since a partial web divided into three and which is displaced by half a web width, does not meet the former for which it is destined.

DE 100 03 026 C1 discloses a device for processing a web, and having at least one former and a cutter arranged upstream of it. The cutter and the former can be moved transversely to the running direction of the web by a common actuating member.

Web processing elements or web guide elements, which are embodied as turning bars, as longitudinal cutters and as a registration roller are disclosed in U.S. Pat. No. 3,734,487. These elements can be prepositioned by individual drive mechanisms with regard to a planned production run.

EP 0 457 304 A1 relates to a mechanism of a device for folding pockets. It includes two processing elements which can be moved in opposite directions by a common drive mechanism.

SUMMARY OF THE INVENTION

The object of the present invention is directed to providing devices for processing and/or for conveying a web, as well as methods for their regulation.

In accordance with the present invention, this object is attained by the provision of a device for either processing or conveying a web in a machine which works with the web. At least one web processing tool is embodied as a former, or as a cutter that is arranged on the web travel path before the former. The cutter and the former are movable by at least one actuating member transversely to a running direction of the web of material. A turning bar unit is arranged upstream of the former. The turning bar is movable transversely to the web running direction by an independent drive mechanism. The drive mechanisms for the former and the turning bar are in connection with a common control device.

A substantial advantage to be obtained by the present device or by use of the present method rests, on the one hand, in that an extensive setting, at the time of the start of the production, is omitted. In contrast to settings taking place at the start of printing, and by the use of control circuits, the amount of waste can be reduced.

A particular advantage of the present invention is that it makes possible a rapid adaptation of the web processing device to a change of the web widths to be processed. A user of the device does not have to gain individual access to every web processing tool which must be displaced for adaptation to the web width.

Further time savings result if the control unit itself is configured to automatically calculate, and to set the positions of the various processing tools which are required to be correlated with each other, from a small number of input parameters. In the simplest case, it suffices, for the calculation of these positions, to merely preset the width of a web to be processed. From this preset information, the control unit can determine the required position of all of the web processing tools in a simple way with one provision. For example, regardless of their widths, a reference line of all of the webs to be processed, such as, for example, a right edge or a left edge, or preferably the center line, takes up the same position.

Since the displacements of some web processing tools, which are required for adaptation to a changed web width, are fixedly correlated, the device, in accordance with the present invention, can be simplified. One actuating member can be used for simultaneously displacing several web processing tools.

A former is a part of the web processing tools of the device in accordance with the present invention. With a suitable selection of the reference line, it may be sufficient if only one of two formers is to be displaced. However, if the center line of the web to be processed is selected as the reference line, which selection is preferable, at least both side-by-side arranged formers must be displaceable.

To generate several partial webs from a single initial web in the device in accordance with the present invention, each of which partial webs then can be fed to individual formers, the device in accordance with the present invention usefully has at least one cutter for use in longitudinally cutting the initial web into partial webs. If more than one such cutter exists, at least one of them must be displaceable.

Furthermore, a device can have at least one interval cutter for the longitudinal cutting of the web of material into pages. If the web of material is a printed paper web, and in particular is a newspaper, such an interval cutter can be employed for cutting the web locally at the height of every respective second page. This can be done in order to produce, for example, a broadsheet signature with a tabloid insert.

It is also of advantage if the device of the present invention has a longitudinal cutting arrangement with at least one cutter, which is also preset transversely to the running direction of the web. This is advantageous in order to fix the cutting line for the partial webs to be created.

If an initial web, which is cut into several partial webs, is being processed in the device, traction or interceptor rollers, provided as web processing tools, are usefully assigned to each partial web in the same way. It is therefore desirable that such rollers are also automatically positionable by the control unit in accordance with the width of the initial web to be processed and the number of partial webs into which the web is longitudinally cut.

Turning bars can also be provided as processing tools, which turning bars can be displaced by the use of the control unit. Also, here, and in the discussion which follows, web conducting devices, web drive mechanisms and/or web guidance devices such as, for example, turning bars, contact pressure rollers and/or guide rollers, are also understood to be processing tools.

To drive the displacement movement of the processing tools, the actuating members preferably each have a threaded spindle. The displaceable processing tools each have a sliding block, which block is in engagement with such a threaded spindle.

The threaded spindle can advantageously have several sections which differ in their thread direction of rotation and/or gradient. The sliding blocks of several processing tools of the same type can each be in engagement with the different sections of an identical spindle in order to displace the processing tools in a coupled manner. However, such displacement may be in different directions and/or at different speeds, as required.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1A:
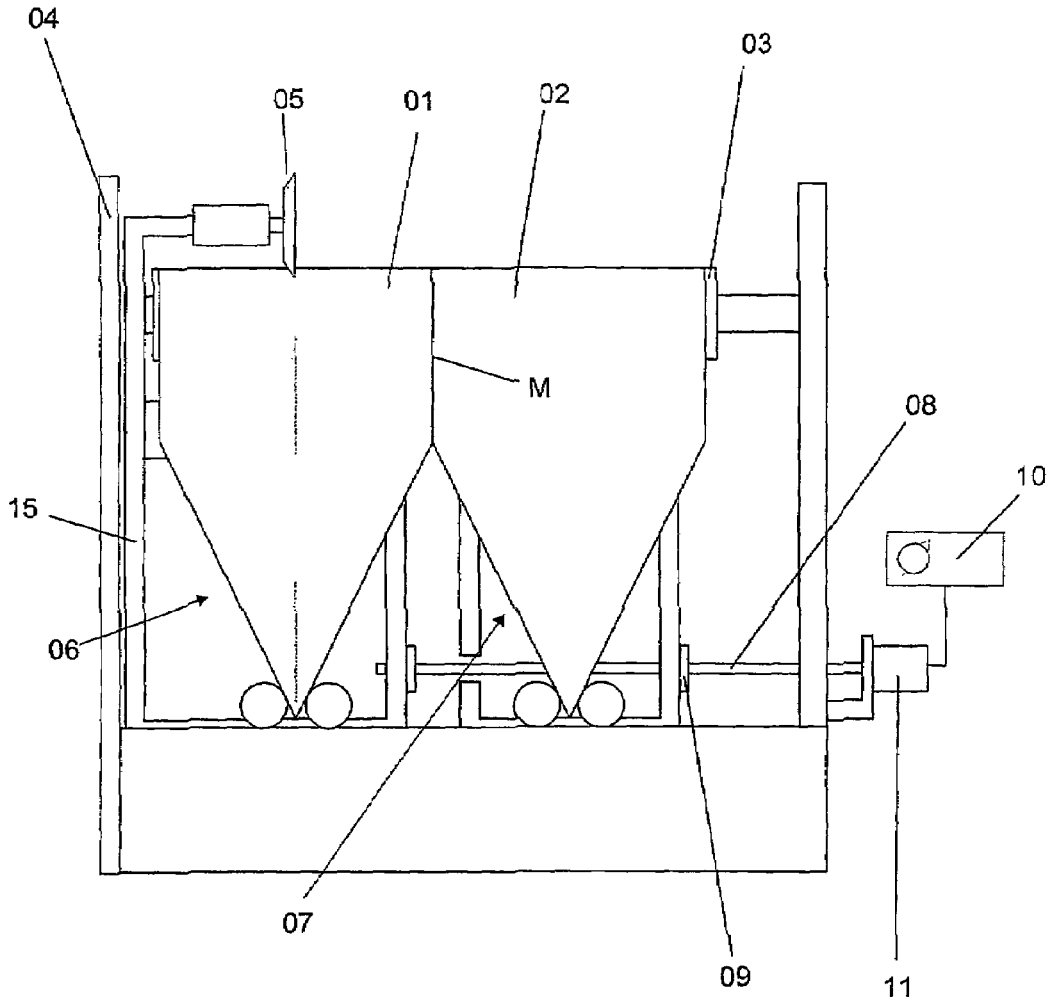
FIG. 1*a*, displaceable formers of a web processing machine, set for a broad paper web, in FIG. 1*b*, displaceable formers, set for a narrow paper web, in FIG. 2*a*, an interceptor roller with displaceable rollers, set for a broad paper web, in FIG. 2*b*, an interceptor roller with displaceable rollers, set for a narrow paper web, in FIG. 3*a*, a longitudinal cutting device with displaceable cutters, set for a broad paper web, in FIG. 3*b*, a longitudinal cutting device with displaceable cutters, set for a narrow paper web, in FIG. 4*a*, displaceable crossed turning bars, set for a broad paper web, in FIG. 4*b*, displaceable crossed turning bars, set for a narrow paper web, in FIG. 5*a*, displaceable parallel turning bars, set for a broad paper web, in FIG. 5*b*, displaceable parallel turning bars, set for a narrow paper web, in FIG. 6, displaceable crossed turning bars with a common drive mechanism, in FIG. 7, displaceable parallel turning bars with a common drive mechanism, in FIG. 8, a former, movable in the web running direction, and in FIG. 9, a schematic representation of a printing press, all in accordance with the present invention.

A former arrangement of a web processing machine is represented in FIG. 1*a*. Two partial paper webs 01, 02 are conducted side-by-side over a roller 03 and thereafter into two formers 06, 07. The formers 06, 07 are displaceably seated in a frame 04 parallel with the shaft of the roller 03. An actuating member for displacing the formers 06, 07 is constituted by a threaded spindle 08, which spindle 08 extends parallel with the shaft of the roller 03 and has two thread sections with opposite, identical thread gradients and a drive mechanism 11, such as, for example, an electric motor 11, for accomplishing the rotary driving of the threaded spindle 08. The drive mechanism 11 and the gear moving the former 06, 07 can also be configured in another way. Each of the formers 06, 07 can be provided with a sliding block 09. The two sliding blocks 09 are each in engagement with a different section of the threaded spindle 08, so that a rotation of the threaded spindle 08 drives the formers 06, 07 to make oppositely directed movements. An electronic control unit 10, or a system S for presetting, as will be discussed subsequently, controls the electric motor 11 in accordance with a width of the paper webs 01, 02 entered by the user in the control unit 10, or stored in the system S. The information regarding the width of the paper webs 01, 02 can also be implemented in the control device 10, or in the system S in other ways, such as, for example by reading in a common value or a value which is pre-stored in a production planning system, a printing press control, an imposition pattern and/or a control console, which is equivalently identified in FIG. 9 at P.

Figure 1B:
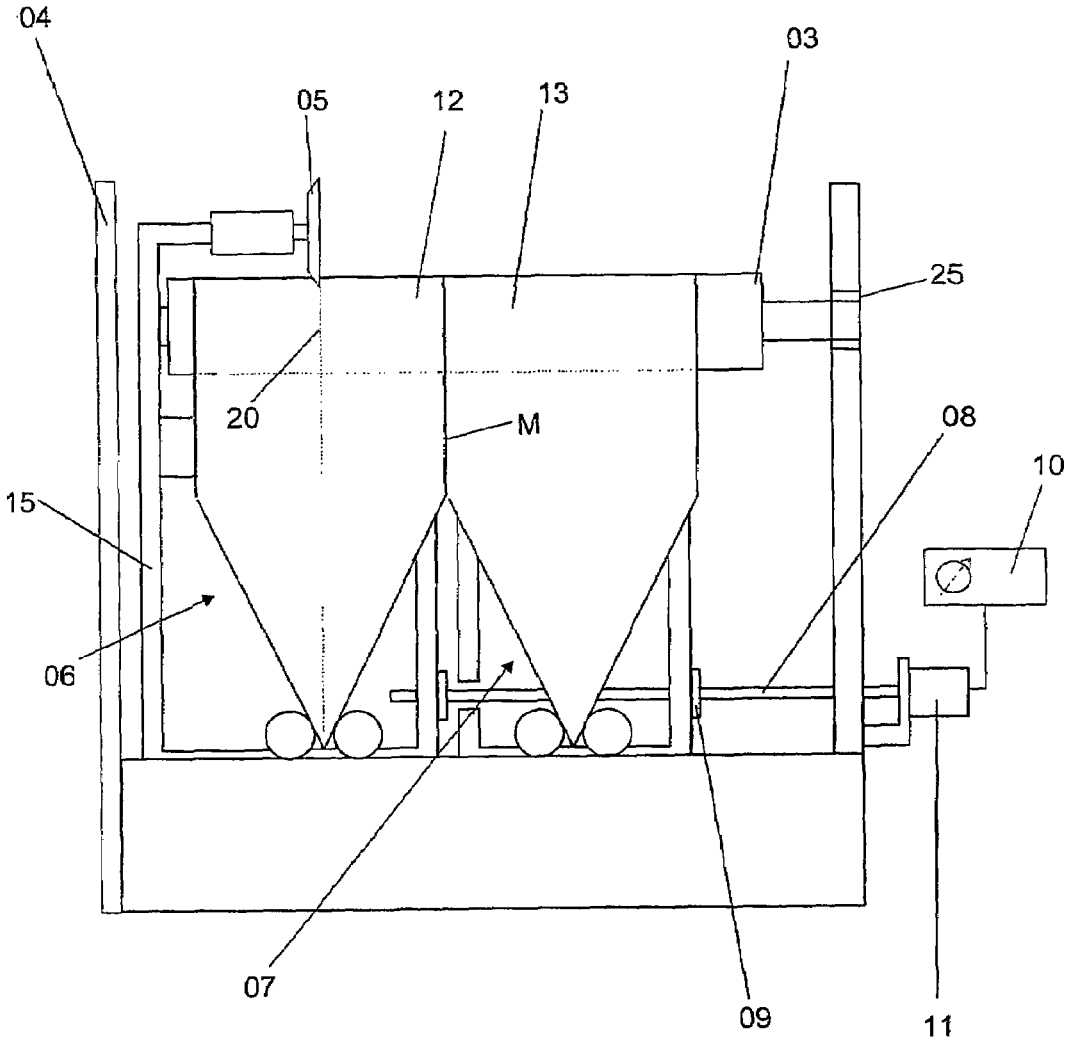

A frame 15 or a stand 15, which is connected with the left former 06, is simultaneously used as a support for a bearing of the roller 03. The roller 03 accordingly follows each movement of the former 06. The right side of the roller 03 is telescopically displaceable on a journal which is fixed on the frame 04, such as, for example, by the use of an axially displaceable bearing 25, as shown in FIG. 1*b*. In the course of the displacement of the former 06, the roller 03 for that former is also displaced, as well as is a groove 20, shown in dashed lines in FIG. 1*b*, encircling the roller 03, which groove 20 works together with a cutter as a cutting groove for continuous or for intermittent longitudinal cutting of the web.

An interval cutter 05, or a skip slitter 05, is also rigidly connected with the former 06, such as, for example, via the stand 15, and is mounted above the roller 03. The interval cutter 05 has a rotating, intermittent cutting edge, which edge is aligned with the fold line of the former 06 and which alternatingly respectively cuts one pair of a pair of printed pages alternatingly imprinted on the partial paper web 01, and leaves the other one uncut. If the uncut pairs of sides are sides of broadsheets, with lines oriented transversely with respect to the conveying direction, and the cut pairs are tabloid pages, whose lines are oriented in the conveying direction, it is possible, in a simple manner, to produce a signature with an insert of half a page size from the partial paper web 01 in a connected folding apparatus, which is not specifically represented.

The setting of the formers 06, 07 for use in processing two partial paper webs 12, 13, which with respect to the partial paper webs 01, 02 of FIG. 1*a*, are narrower by the value "d," is represented in FIG. 1*b*. The center line M, where the webs 12, 13 touch each other, has the same position in relation to the stand as does the center line M between the webs 01, 02 in FIG. 1*a*. To set the formers 06, 07 for processing such narrow partial paper webs 12, 13, the threaded spindle 08 is rotated by operation of the electric motor 11, so that the formers 06, 07 are each respectively displaced by d/2 in the direction toward the center line M.

In an advantageous variation, or a further development of the present invention, a driven roller 30, which is arranged downstream of the former tip with the former 06, 07 in addition to, or in place of the cutter 05, is laterally movable together with, or at the same time as, the former 06, 07. To this end, the former 06, 07 is preferably connected with a support for, or a seating of the roller 30, preferably by the use of a common stand 15. In the course of displacing the former 06, 07, the roller 30 is thus simultaneously moved. The roller 30 may be embodied as a driven transfer roller 30, over which a continuous web, which is leaving the former 06, 07, is conducted and which thus undergoes a directional change. In another embodiment, the roller 30 can be configured as a traction roller 30 of a traction roller group and can be, for example, individually motor-driven, and against which a contact pressure roller 35 can be placed. In this case, the entire traction group 30, 35 is connected with the former 06, 07.

A former arrangement, of the type represented in FIGS. 1*a*, 1*b*, could also have three or more formers for use in processing a corresponding number of partial webs. If three parallel partial webs are to be processed, and if their center line M, regardless of the width of the webs, always has the same position with respect to the stand, the two outer formers must be respectively displaced by "d" in case of a change of the partial webs by "d," while the center former remains without being displaced. With four partial webs, the displacement correspondingly is d/2 for the two center ones, and 3d/2 for the two outer ones, etc.

Figure 9:
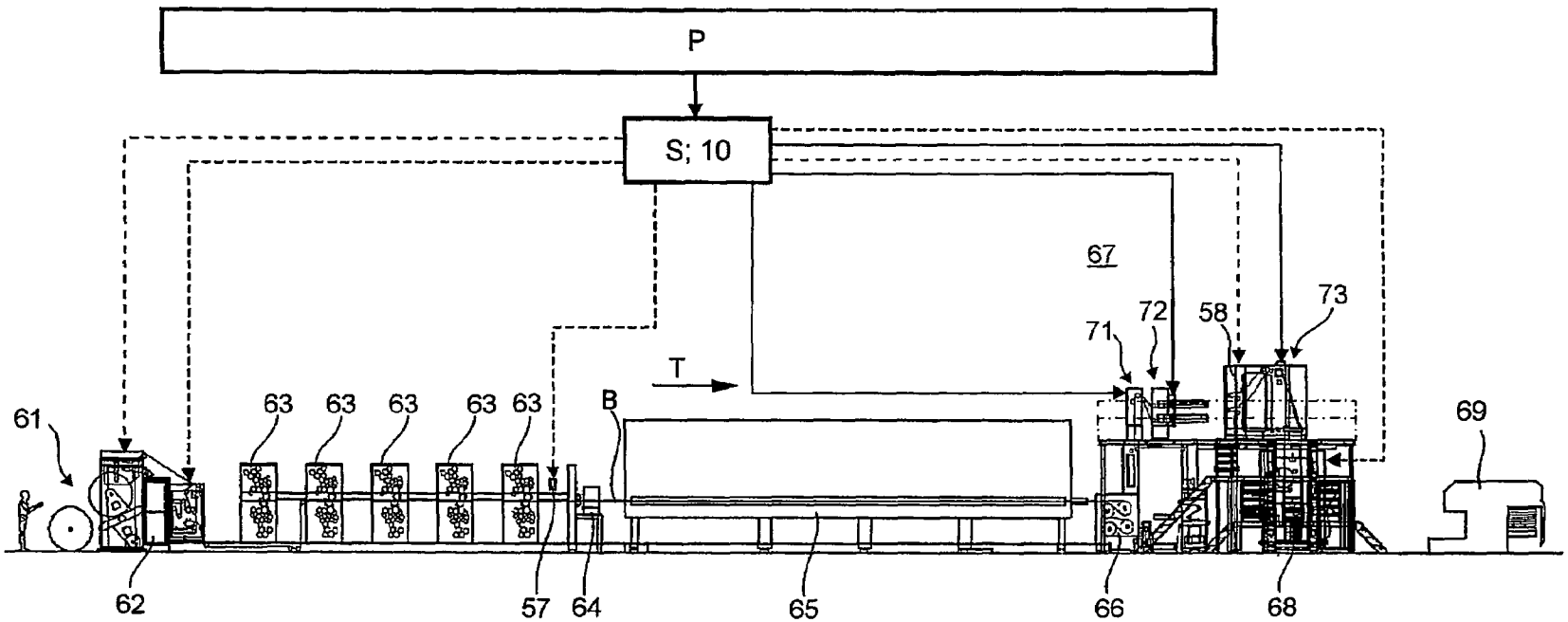

In an advantageous embodiment of the present invention, it has been provided, for the pre-setting the printing press, as seen in FIG. 9 that the control device 10, or the drive mechanism 11 for accomplishing the above-described movement of the former 06, 07, is in a signal connection with the system S. Based on production data, such as, for example, the web width or the partial web width b, b', the actual position of the former 06, 07 is compared with a position which has been or which can be preset for this production. If required, a corresponding movement is initiated via actuating commands to the respective drive mechanism 11. Depending on the width of the web or the partial web and/or the position of its center, the former 06, 07, or the former tip should be correspondingly laterally positioned. For example, the former 06, 07 is positioned in such a way that the partial web 12, 13 runs up to the respective former 06, 07 which is centered with respect to the former tip. It is possible for presetting values for the various production runs to be stored in the form of tables. Alternatively, a calculation takes place in the system on the basis of the web paths resulting from the web widths and from the lateral offset.

Figure 2A:
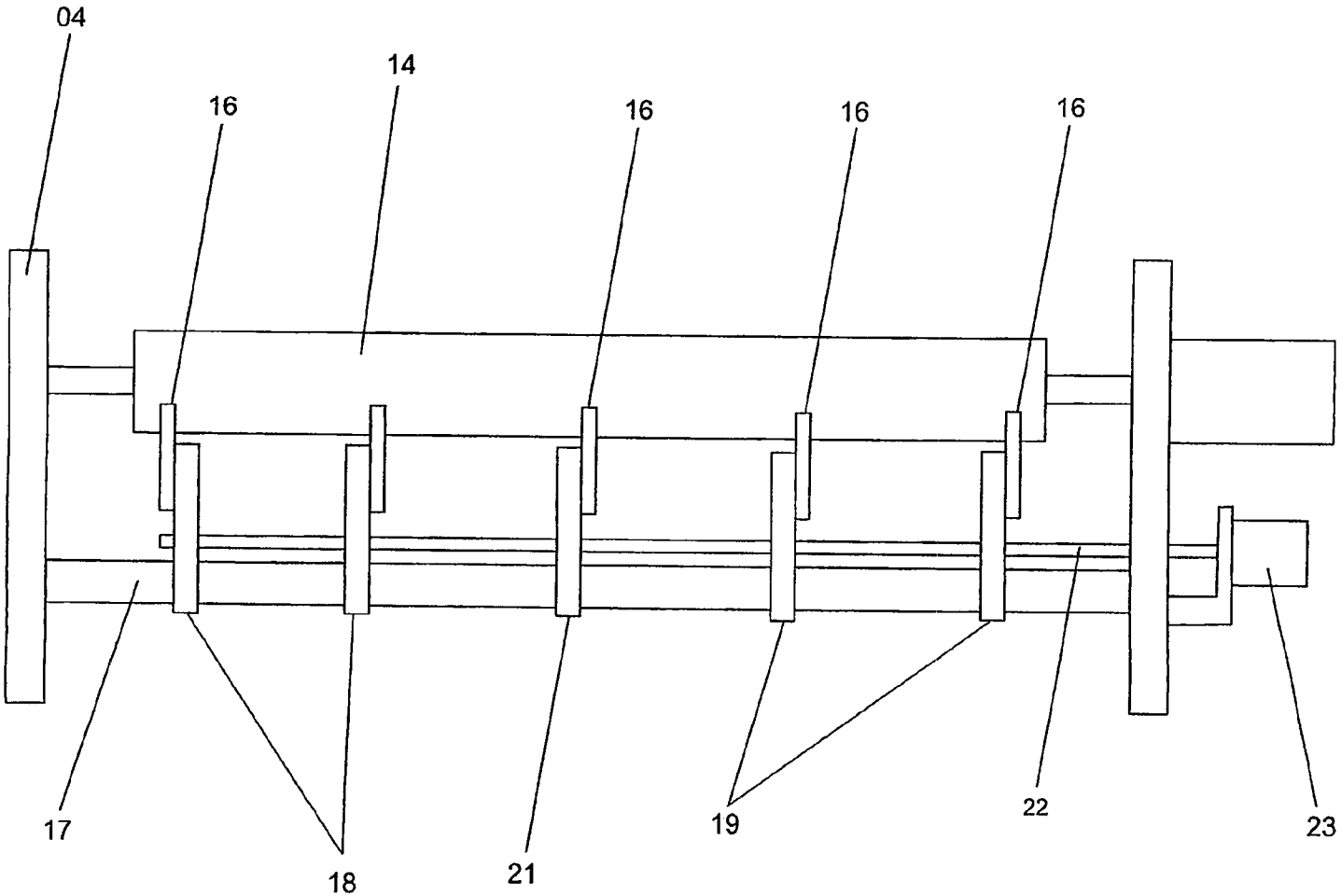

FIG. 2*a* shows an interceptor roller arrangement as a further example of a web processing tool in a device in accordance with the present invention. This interceptor roller arrangement consists of a roller 14, around which a paper web, which is not specifically represented in the drawing, and which is to be intercepted, is wrapped during production. The arrangement also includes several rollers 16, several sliding blocks 18, 19, 21, a guide rail 17, a threaded spindle 22 and an electric motor 23, which is controlled by the previously described control unit 10, or the system S.

The roller 14 is rotatably seated in the frame 04. The guide rail 17 is seated in the frame 04 and is parallel with the roller 14. Several of the sliding blocks 18, 19 are displaceably arranged on the guide rail 17. A sliding block 21, which is arranged so as to be centered with respect to the roller 14, is fixedly arranged on the guide rail 17. Each of the sliding blocks 18, 19 and 21 supports a rotatably mounted roller 16. In this depicted configuration, the rollers 16 press against the roller 14 and roll off on it. Since the rollers 16 are intended to be rotatable in only one direction, they prevent a return movement of the paper web which is wrapped around the roller 14 in case of a possible paper web break.

The threaded spindle 22 passes through the frame 04, on one side of the frame 04, and projects from the frame 04 at this point. In this case, the threaded spindle 22 is aligned parallel to the roller 14 and to the guide rail 17. The threaded spindle 22 has two different threaded sections, with threads which turn in different directions, and which threads are separated from each other by a section without a thread. The sliding block 21 is arranged on the threaded spindle 22 in this threadless section. The two threaded sections have thread gradients which increase along a longitudinal axis of the threaded spindle 22 proportionally to their distance from the fixed sliding block 21. The sliding blocks 18, 19 are themselves not in engagement with the left or right threaded section, as viewed from the sliding block 21, by an interior thread with several turns. Such an engagement would become stuck because of the variability of the thread gradient of the threaded spindle. Instead, each sliding block 18, 19 is provided with a single narrow pin which engages the thread of the threaded spindle 22 and which pin is located on a small circumferential section of the respective sliding block 18, 19. The electric motor 23 engages the threaded spindle 22 at the end section of the threaded spindle 22 that is projecting from the frame 04.

Figure 2B:
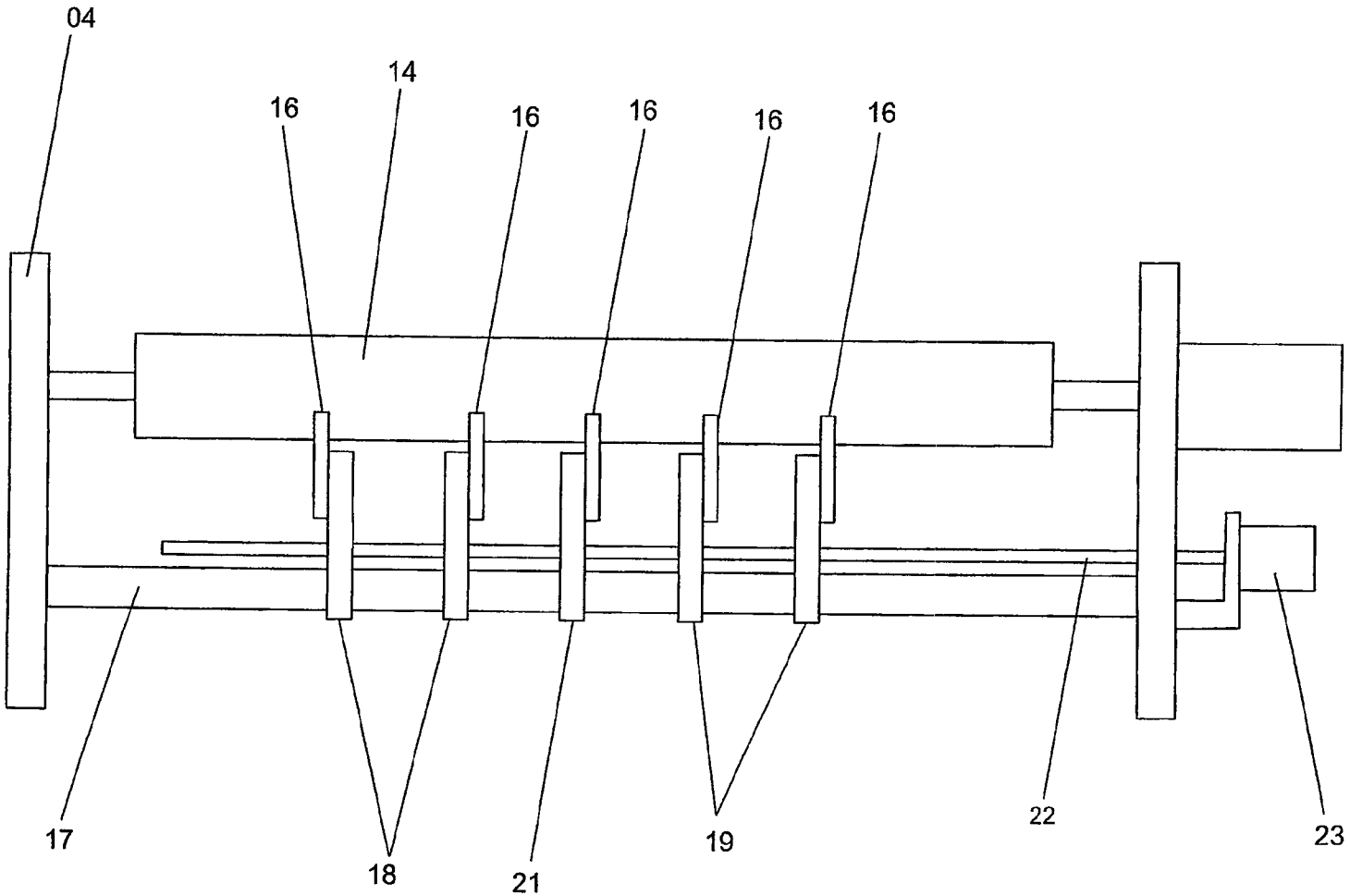

If the interceptor roller depicted in FIG. 2*a* is intended to be used in connection with a paper roll of lesser width, the sliding blocks 18, 19 are displaced along the guide rail 17, as represented in FIG. 2*b*. In this process, the threaded spindle 22 is rotated by the drive mechanism 23. Because of the different direction of thread rotation of the two threaded sections of the threaded spindle 22 which are in engagement with the sliding blocks 18 or 19 respectively, in the course of rotation of the threaded spindle 22 the sliding block 18 moves from the left and the sliding block 19 from the right in the direction toward the center sliding block 21. In this case, the movement of the sliding blocks 18, 19 takes place synchronously, but as a result of the gradients of the threaded sections, which gradients change along the longitudinal axis of the threaded spindle 22, the paths traveled by the sliding blocks 18, 19, and therefore also by the rollers 16 which are conducted by them, differ proportionally with respect to their distance from the center sliding block 21. Depending on the width of the paper web to be processed, the sliding blocks 18, 19 can be continuously displaced to move more or less close to the sliding block 21 by an appropriate turning of the threaded spindle 22. In this way, the interceptor roller can be set for any arbitrary paper web width. Prior to their displacement, the sliding blocks 18, 19 can be placed in any arbitrary position along the spindle 22. The ratio of their distances is maintained during a displacement of the sliding blocks 18, 19.

It is also within the scope of the present invention to provide two threaded sections, each with a thread gradient which remains the same over each section's length. This is sufficient for a roller arrangement with no more than three different rollers 16. In the case of a larger number of rollers, as represented in FIG. 2*b*, the distance between the two left sliding blocks 18, and also the distance between the right sliding blocks 19, would remain constant if they are displaced, and the distance relationships would change in case of a displacement.

Another option in accordance with the present invention would be to provide each individual one of the four sliding blocks 18, 19 with its own threaded section of the threaded spindle 22, with each section being provided with a specific gradient. However, in that case, the variability of the web widths to which the interceptor roller can be set is restricted in that the sliding blocks, or at least those which are coupled to the spindle by an interior thread with several turns, could not leave the threaded section having the specific thread gradient suitable to their thread.

It is also possible to provide several threaded spindles, each with two sections of opposite, identical gradients, each of which spindles supports sliding blocks of rollers which are located opposite each other in a mirror-reversed manner, in relation to the center line M. For practical purposes, these several threaded spindles are identical to each other. To achieve different displacements of the rollers coupled with them, the several threaded spindles can be driven by a common electric motor via a gear with a respectively matched transmission ratio. Alternatively, each threaded spindle can have its own electric motor, which is respectively individually triggered by the control unit according to the required displacement.

In the above-described manner, it is also possible to configure traction roller arrangements in a manner which can be set for paper webs of different widths to be processed. This is because traction roller arrangements in principle have a structure to that of interceptor roller arrangements. Such presetting values can be stored in tables for the different production runs. Alternatively a calculation can take place in the system S on the basis of the use from the web widths and the lateral offset to be obtained.

Figure 3A:
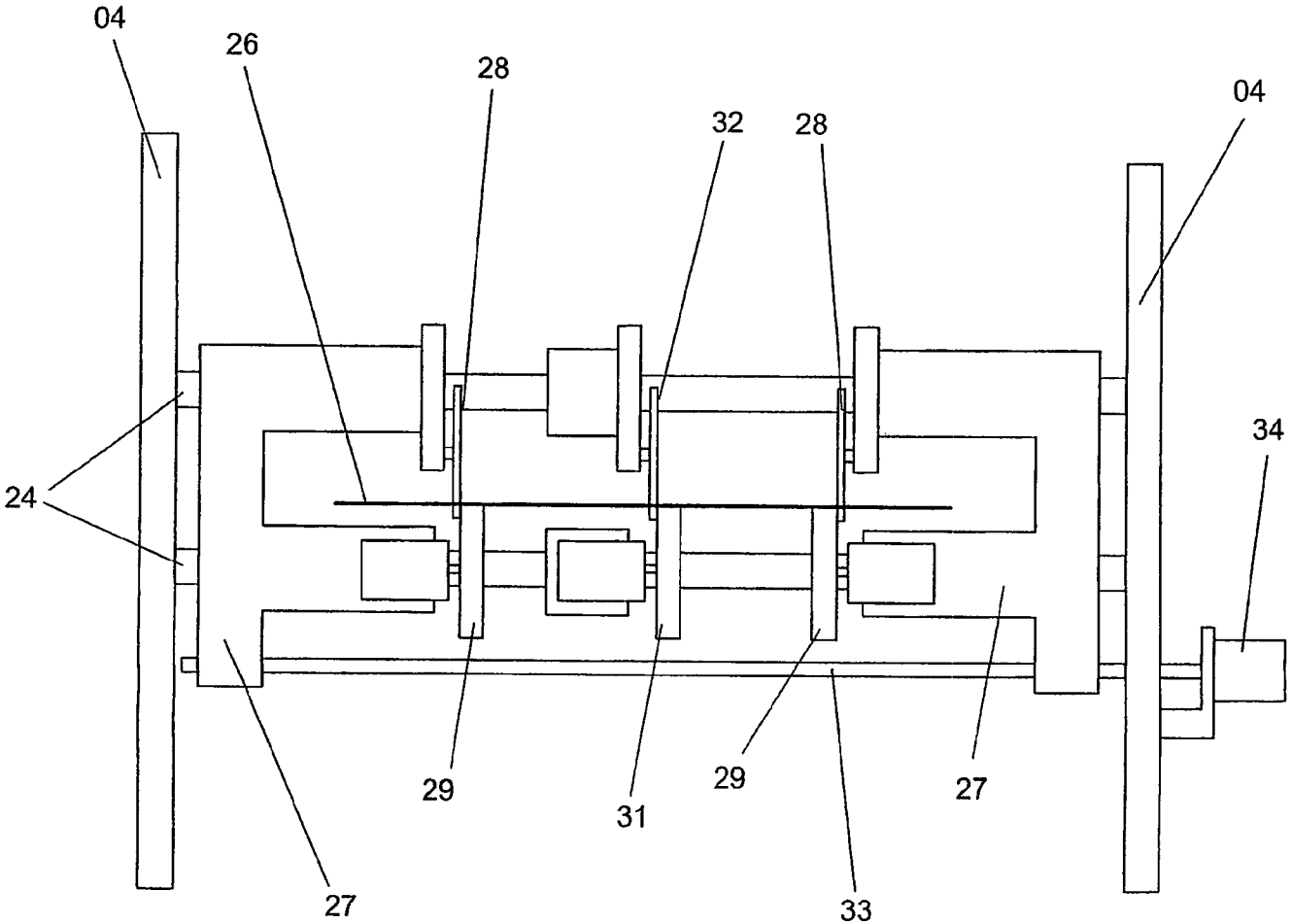

FIG. 3*a* shows a detailed depiction of a longitudinal cutting arrangement 71 of a superstructure 67, as seen generally in FIG. 9. The longitudinal cutting arrangement 71 is configured for longitudinally cutting an incoming web into several partial webs, such as, for example, into two partial webs. In this case, two guide rails 24 are arranged parallel to each other, and supported in the frame 04. A paper web 26 is conducted between the two guide rails 24. Two carriages 27 are displaceably maintained on the two guide rails 24. They are configured and are mounted mirror-reversed with respect to each other. Each carriage 27 supports a rotating cutter 28 with cutting edges that are oriented perpendicularly with respect to the paper web 26, and a counter-pressure roller 29, or counter-cutter, which is working together with the cutter 28. A further cutter 32 is located between the carriages 27, which further cutter 32 also extends perpendicularly with respect to the paper web 26, and a further counter-pressure roller 31 is provided for working together with the further cutter 32. The paper web 26 is cut longitudinally into four partial webs by the cutters 28, 32 and the coordinating counter-pressure rollers 29, 31. A threaded spindle 33, which is parallel with the guide rails 24, has two spindle sections, of different directions of thread rotation and of the same thread gradient, each of which sections is in engagement with one of the carriages 27. An end section of the threaded spindle 33 projects out of the frame 04 on one side. A drive mechanism 34, such as, for example, an electric motor 34, for the rotary driving of the threaded spindle 33 is provided and is connected to this end section. The individual cutters 28, 29, or their respective counter-cutters, can also be drivable together by a different type of common drive mechanism 34, or by individual drivers for each cutter or for pairs of cutters.

Figure 3B:
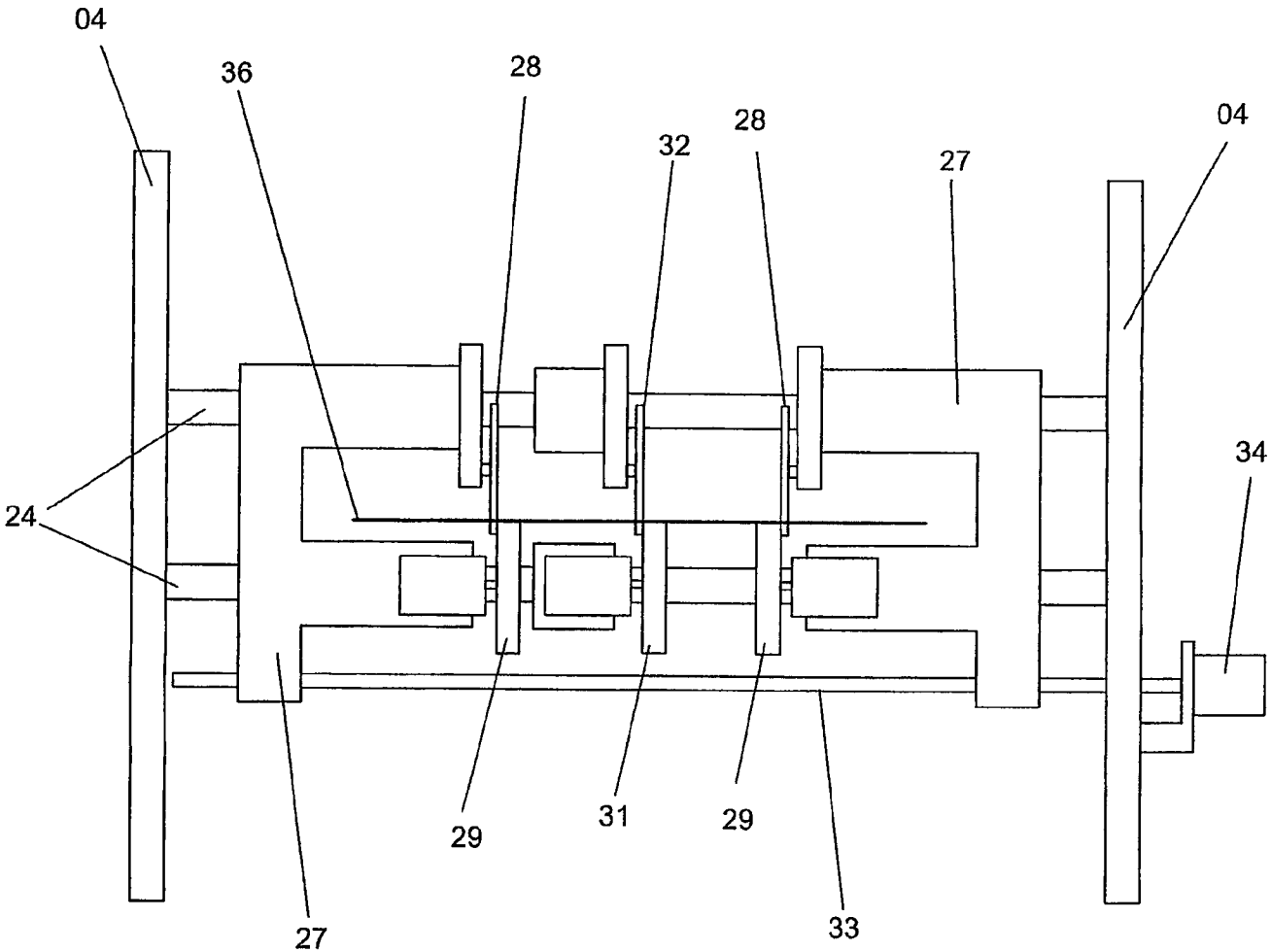

If the above-described longitudinal cutting arrangement is intended to be used to cut a paper web 36 of narrow width into four partial webs, the threaded spindle 33 is rotated by the electric motor 34, to position the carriages 27 as shown in FIG. 3*b*. Since the carriages 27 are in engagement with different threaded sections of the threaded spindle 33, which different threaded sections have different directions of thread rotation and the same thread gradient, the rotation of the threaded spindle 33 causes each of the carriages 27 to move over the same distance in a direction toward each other, or toward the center cutter 32. The turning of the threaded spindle is continued until the distance between two cutters 28, 32 corresponds to a quarter of the width of the narrow paper web 36.

The operation of the spindle drive motor 34 is controlled, or is preset, by the control unit 10, or by the system S, which calculates the position of the cutters 28 by the use of a width of the web to be cut, as set by the user, or which width is automatically detected by sensors which are not specifically represented, or of the partial webs resulting from the cutting.

In the case of several cutter units, such as pairs of cutters 28, 32 and counter-cutter 29, it is possible, for example, to drive them all separately, and/or to bring them into and out of contact individually.

The axial positioning or at least the pre-setting of the printing press control is preferably performed automatically on the basis of the width of the web intended for being imprinted and of the cutting lines to be made specifically with respect to the product, or is performed manually from an operating console. To this end, a check is made, for example prior to production start, by the system S, from the printing press control or from an appropriate software program, regarding the actual setting with respect to pre-setting values that are required for the planned production, and/or a pre-setting, by acting on the drive mechanism 34, or the drive mechanisms 34 is performed. Such presetting values can be stored in tables for the different production runs, or a calculation can take place in the system S on the basis of the use from the web widths and from the lateral offset to be obtained.

Figure 4A:
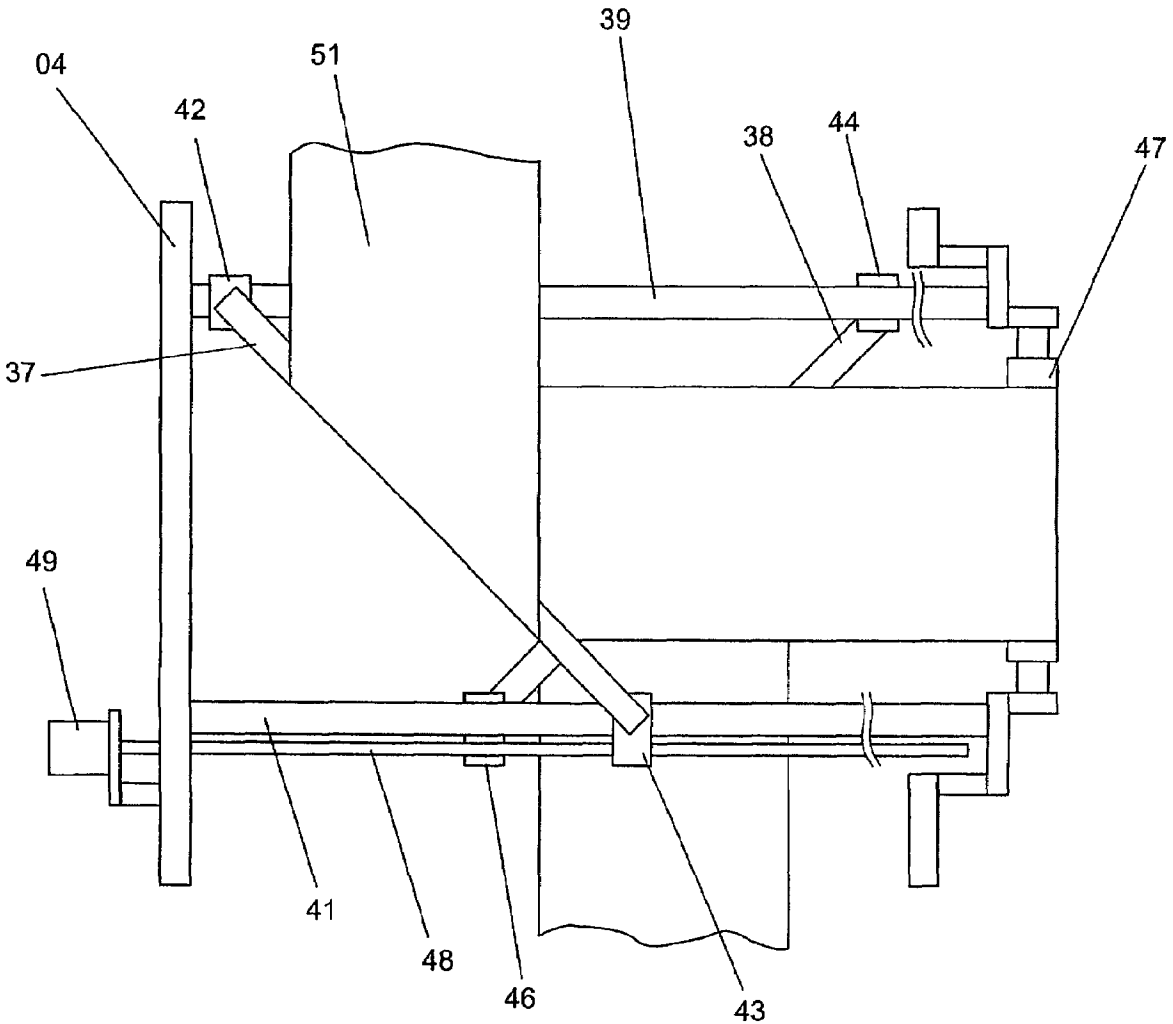

A turning-bar deck, with two crossed turning bars 37, 38, is represented in FIG. 4*a* as a further example of web processing tools which can be provided in the device in accordance with the present invention. Two pairs of guide rails 39, 41, the front one being identified by 41, the rear being identified by 39, are maintained between plates of the frame 04. Only the upper guide rail of each pair of guide rails 39, 41 can be seen in the drawing figure, since the upper rail 39, 41 covers the associated rail 39, 41 that is located parallel with, and underneath it. A sliding block 42, 43 is provided at each of the ends of the turning bar 37. The sliding block 42 is slidingly arranged on the visible upper guide rail 39 of the rear guide rail pair, and the sliding block 43 is arranged on the visible upper guide rail 41 of the front guide rail pair. Correspondingly, two sliding blocks 44, 46 are provided at the ends of the turning bar 38. The sliding block 44 is slidingly arranged on the not visible lower guide rail 39 of the rear guide rail pair, and the sliding block 46 is arranged on the not visible lower guide rail 41 of the front guide rail pair.

A reversing roller 47 is rotatably arranged in the frame 04 between the guide rail pairs 39 and 41 and extends transversely in respect to them.

A paper web 51, which enters perpendicularly, with respect to the guide rail pairs 39 and 41, runs around the oblique first turning bar 37 and thereby changes its travel direction by 90°. Web 51 then loops around the reversing roller 47 and runs from there back again and over the obliquely placed second turning bar 38, which is crossed by the first turning bar 37. The web's running direction is again changed by 90°, so that after leaving the turning bar deck web 51 has regained its original running direction, but has been offset by exactly one paper web width and has been inverted.

A pair of threaded spindles 48, which are parallel with the guide rails 39, 41, and of which pair, a lower threaded spindle 48 is hidden by the upper threaded spindle 48 in the drawing figure, is rotatably seated in the frame 04. A drive mechanism 49, such as, for example, an electric motor 49, acts on an end section of each spindle 48.

Figure 4B:
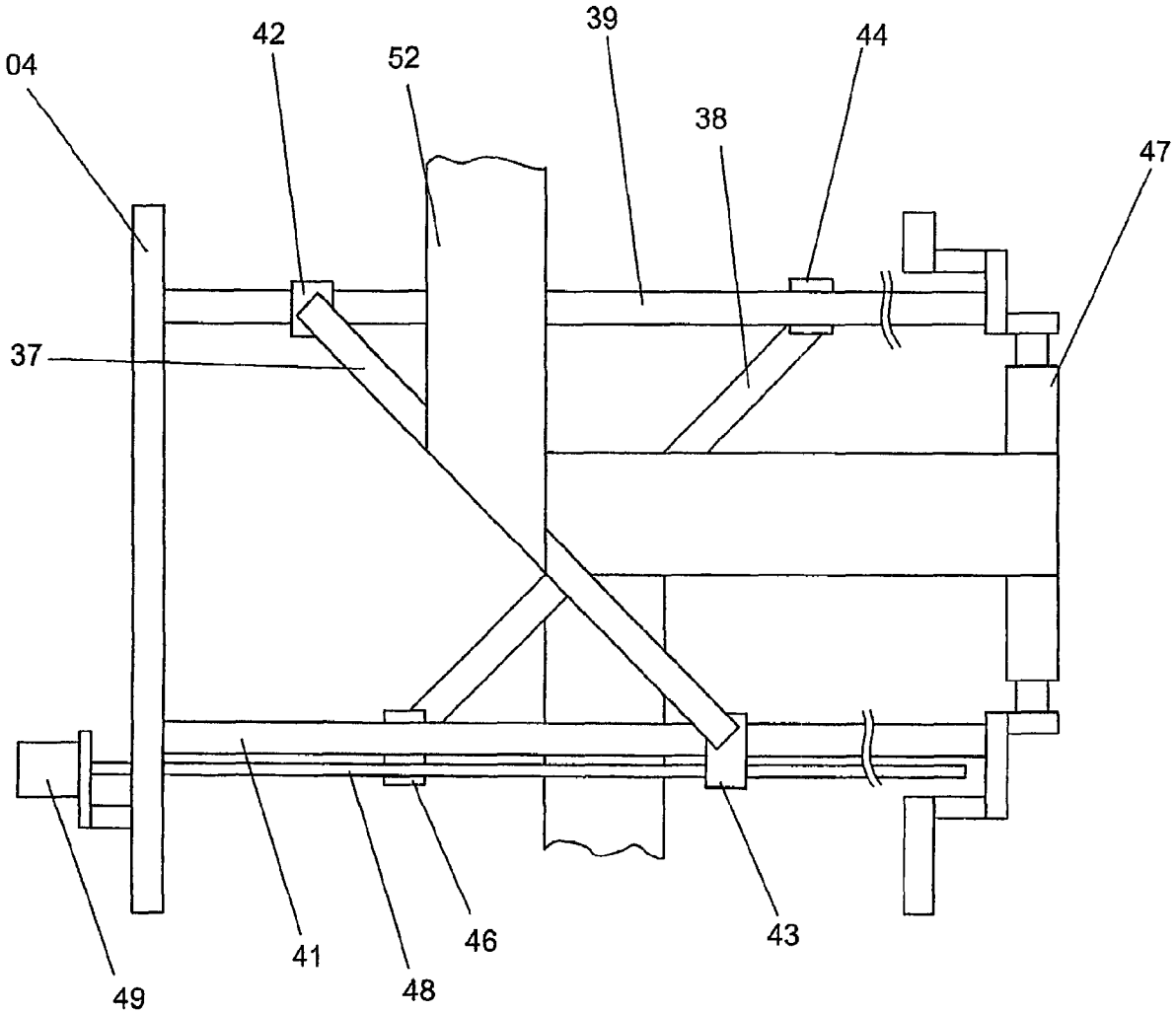

If the above-described arrangement is to be employed for a paper web 52 of a lesser width, as shown in FIG. 4*b*, the distance between the turning bars 37 and 38 has to be changed, so that an offset of exactly one web width is still achieved. To this end, the control unit 10, or the system S, which is not specifically represented in the drawing figure controls an oppositely directed movement of the motors 49, and therefore of the turning bars 37, 38. It is otherwise possible, in particular if more than two partial webs are to be processed, to require a displacement of the turning bars 37, 38 in the same direction in order to assure that the partial webs do not come too close to the ends of the turning bars 37, 38. For this purpose, the control unit 10 or the system S controls each of the motors 49 to run in the same direction.

Figure 5A:
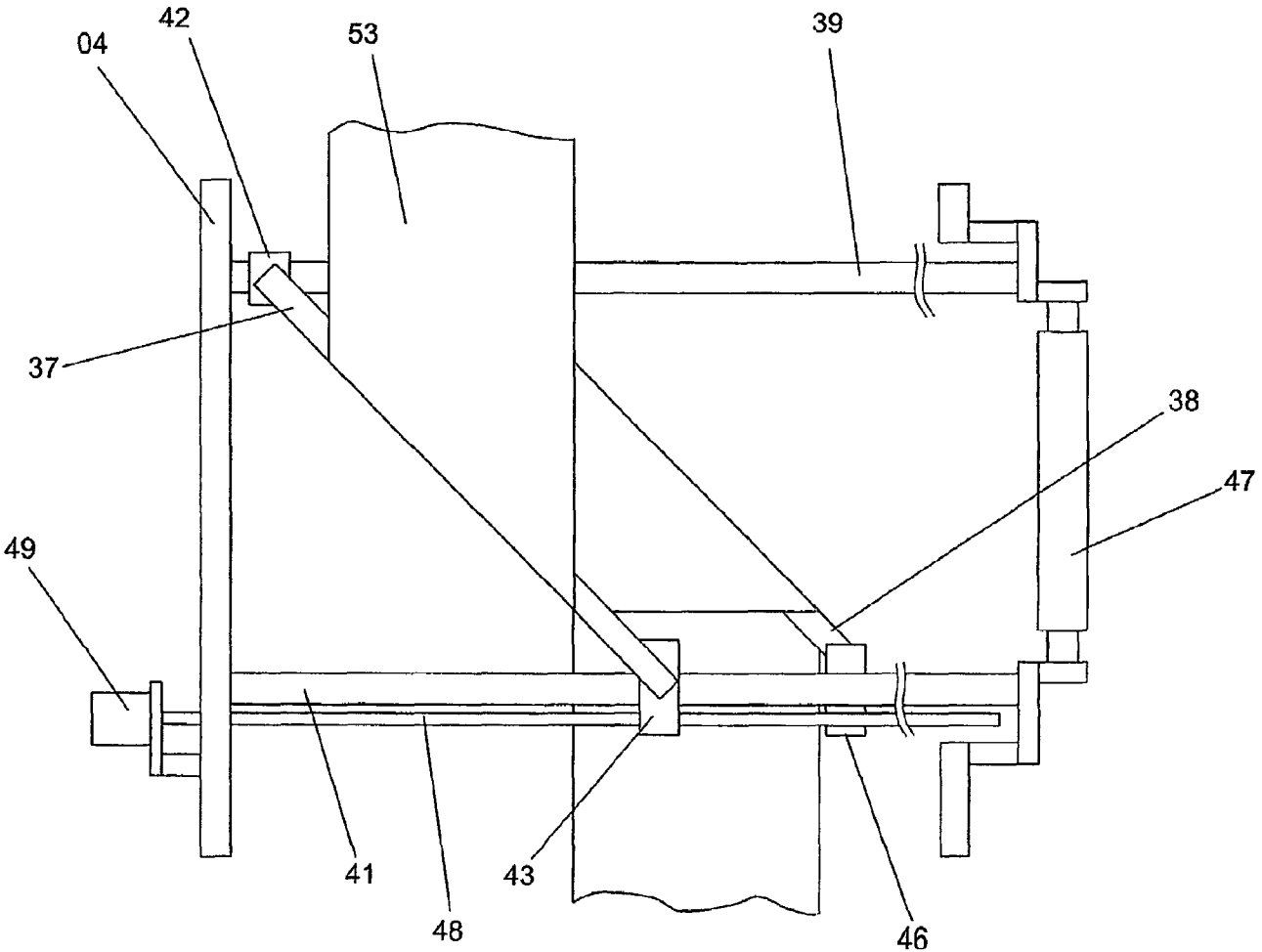

The above-described turning bar deck is represented in FIG. 5*a* following a reconfiguration. In this reconfigured embodiment, the turning bars 37 and 38 are slidingly arranged parallel with respect to each other and are supported by the sliding blocks 42, 43, 44, 46 on the guide rails of the guide rail pairs 39 and 31.

A paper web 53, which is to be offset, enters the turning bar deck perpendicularly with respect to the guide rail pairs 39 and 41, successively loops around the first turning bar 37 and the second turning bar 38, and leaves the turning bar deck, laterally offset by one paper web width, and without having been inverted.

Figure 5B:
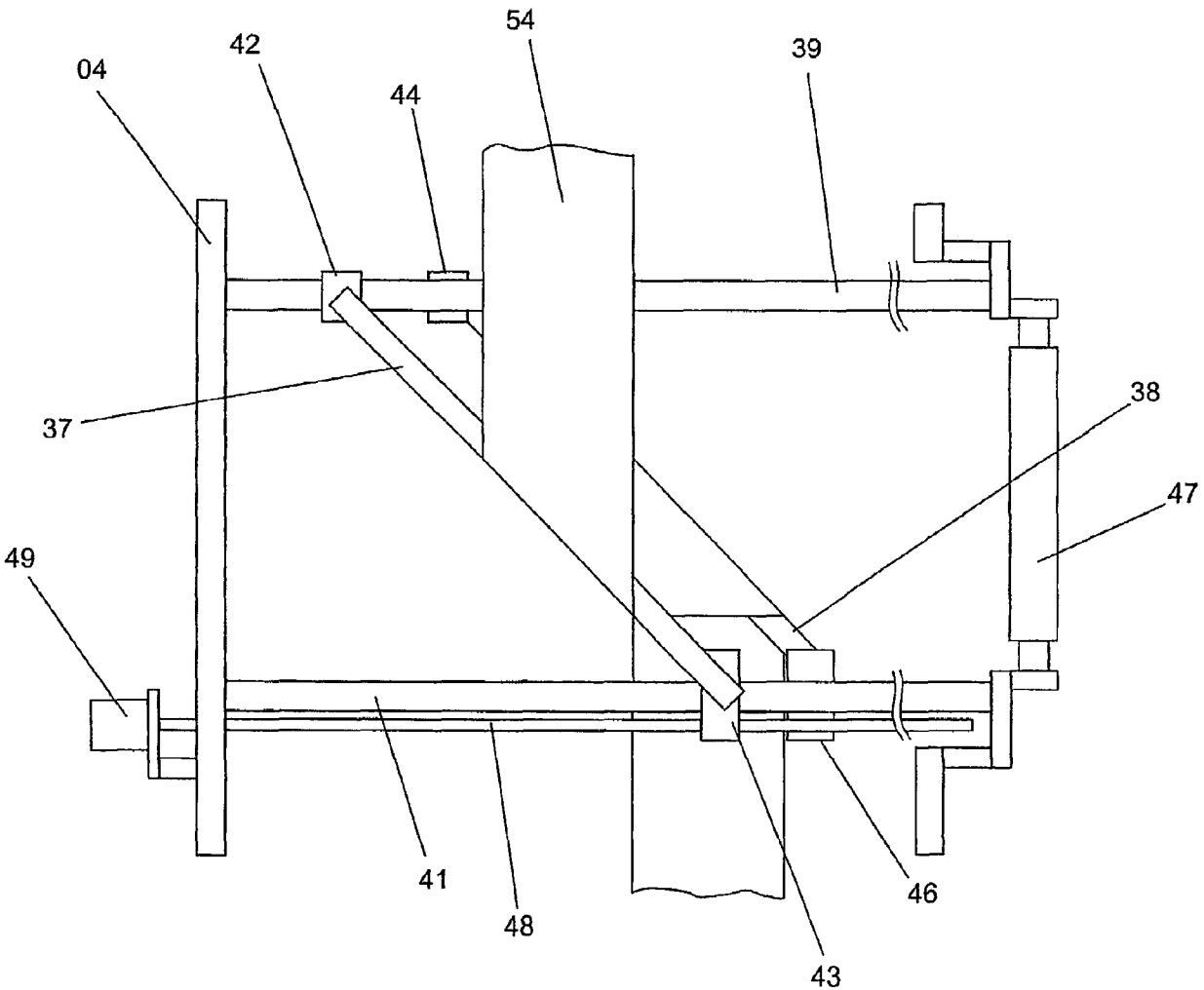

In a manner the same as was the case of FIGS. 4*a*, 4*b*, to match the turning bar deck to a paper web 54, as seen in FIG. 5*b*, which is of a lesser width than the web 53 of FIG. 5A, the control unit 10, or the system S on the one hand moves the turning bars 37, 38 towards each other, so that the distance between the turning bars is matched to the changed web width. If necessary, the control unit 10 also displaces both turning bars 37, 38 in the same direction, so that the web 54 meets the center of the turning bars to a sufficient degree.

Figure 6:
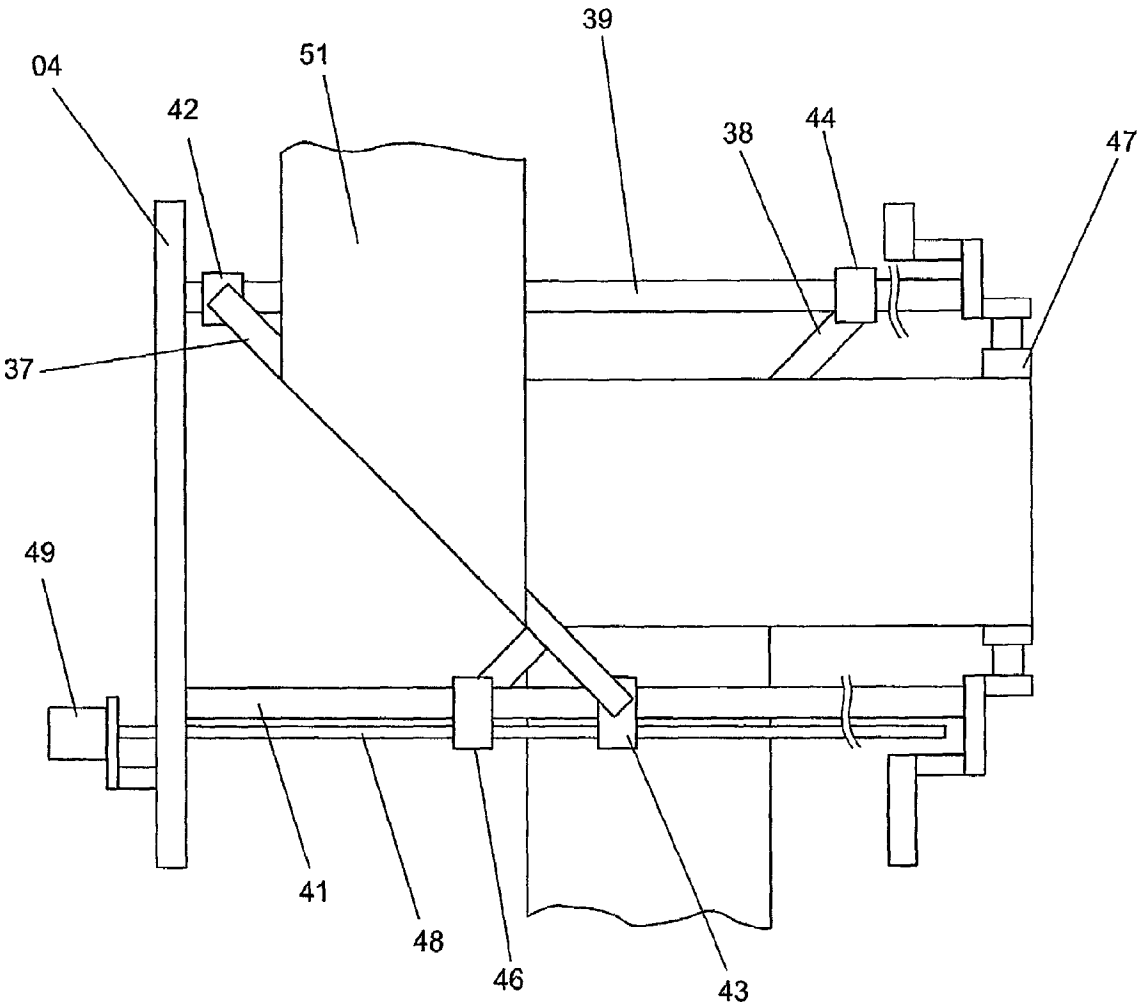

FIG. 6 shows an advantageous embodiment of the turning bar arrangement, discussed previously in accordance with FIG. 4, wherein, however, in FIG. 6 the arrangement has only one support 39, 41 for the two turning bars 37, 38. The sliding blocks 43, 46 slide on the same support 39, 41 and are driven by a common threaded spindle 48, which spindle 48 has two oppositely turning or directed threads, one for each one of the two sliding blocks 43, 46. The spindle 48 is driven by the motor 49, wherein the sliding blocks 43, 46 move in opposite directions in the course of the rotation of the threaded spindle.

Figure 7:
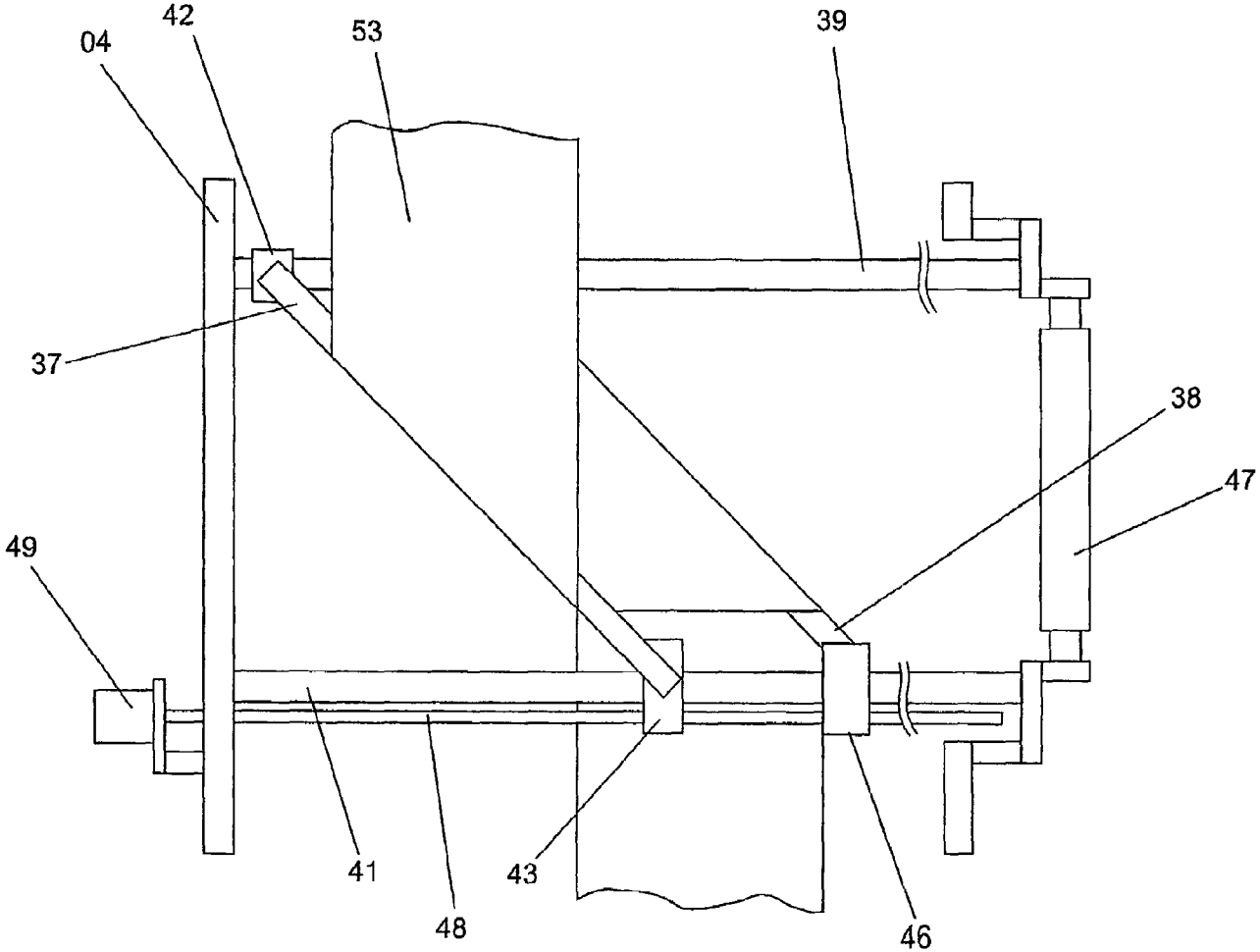

FIG. 7 also shows an advantageous embodiment of the turning bar arrangement, described previously in accordance with FIG. 5. Here, as in FIG. 6, a common threaded spindle 48, with opposite-turning threads for the two sliding blocks 43, 46 is provided. The sliding blocks 43, 46 also are supported by, and run on the same support 41. Driving of the threaded spindle 48, by the common motor 49, causes a movement, in opposite directions, of the two turning bars 37, 38 with their sliding blocks 43, 46.

A turning bar arrangement of a printing press, as depicted in FIG. 9 has at least one turning bar deck with two turning bars 37, 38 assigned to each other, and by the use of which, a partial web 51 to 54 can be brought into a different alignment and/or can be tipped. The turning bar arrangement contains a pair of turning bars 37, 38. In an advantageous embodiment, which is not represented here, two turning bar decks, with two pairs of turning bars 37, 38, are provided for offsetting, or for tipping, two partial webs 51 to 54. As represented, the turning bars 37, 38 of one pair can be arranged either parallel, in relation to each other, and can be inclined by 45° in respect to the incoming web, or offset, or they can be arranged perpendicularly, in respect to each other, and can be inclined by 45° or by 135° in respect to the incoming web to accomplish web tipping and, if desired, web offset.

In advantageous embodiments of the present invention all of the turning bars 37, 38 are configured to be pivotable or to be able to be tipped by 90° in respect to the level of the respective incoming web. In a variation of the structures depicted in FIGS. 4 and 5, a cantilevered seating of the turning bars 37, 38, with a fixed end and with a free end, is also possible. In this cantilever configuration the guide rails 39 are omitted. In a further development, a mechanism, which is not specifically represented, is assigned to each of the turning bars 37, 38, which mechanism detects the actual position of the turning bars 37, 38, tilted or angled either toward the left or toward the right, and reports it to the printing press control, or to the operating console of the printing press, or to the system S. These mechanisms can be, for example, initiators, which are switches that are activated or deactivated mechanically switches, or electromagnetically, such as induction, or a light barrier as soon as the turning bar 37, 38 is in one of its intended positions. The printing press operator, or a program, can then check whether the turning bars 37, 38 are in the position required for the planned production run. An error signal can be issued through the system S if the position of the turning bar 37, 38 does not agree with the intended production, or with the intended web track.

As discussed shown above, in a preferred embodiment of the present invention, every turning bar 37, 38 is, as a whole, arranged in the superstructure 67 to be movable in a direction transversely to the direction of the incoming web. By this movement, the turning bar 37, 38 can be positioned, by use of the drive mechanism 49, so that it is matched to a product, or to a web path, or to a web width.

In an advantageous manner, for presetting the printing press, the drive mechanisms 49 of the turning bars 37, 38 are in a signal connection with the system S. On the basis of production data, such as, for example, the intended web path, resultant theoretical cutting line, and/or width of the web or partial web, the actual position of the turning bar 37, 38 is compared with a position which has been or which can be preset for this production run and, as may be required, an appropriate movement of the turning bars 37, 38 is initiated via actuating commands to the drive mechanisms 49 involved. Such presetting values can be stored in tables for the different production runs. Alternatively a calculation takes place in the system S on the basis of the use, from the web widths and the lateral offset to be obtained.

In a further development of the superstructure 67, a drive mechanism, which is not represented, for use in pivoting, is assigned to the pivotable turning bars 37, 38 which, for example in a manner which is the same as was previously explained in connection with the drive mechanisms 49, is preset by the above-mentioned system S in accordance with the planned production and/or web guidance. Advantageously, such a drive mechanism is, for example, embodied as a cylinder, which can be charged with a pressure medium, which cylinder is engaged, on the one side, with the frame, and, is engaged on the other side, with the turning bar 37, 38 outside of its pivot point.

Figure 8:
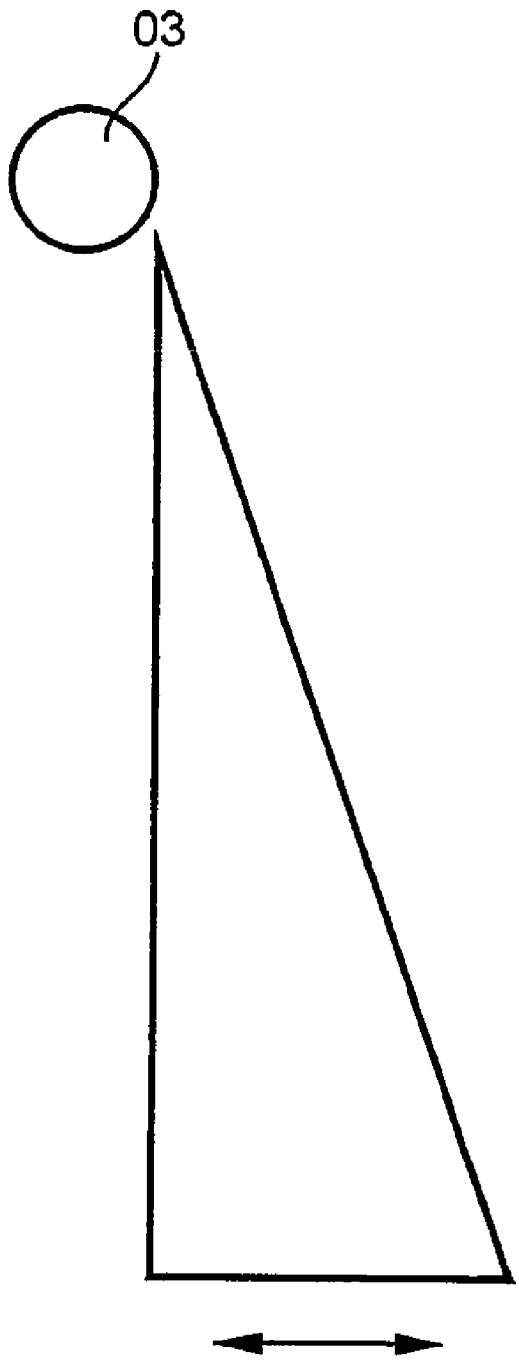

FIG. 8 shows a schematic side elevation view of the web processing tool, which is embodied as a former 06, 07. In an advantageous embodiment the former 06, 07 is movable in a direction, or which has at least a direction component, which is perpendicular with respect to the spine fold of the continuous web leaving the former 06, 07, and/or which is substantially parallel with relation to an axis of rotation of a cylinder, such as a transverse cutting cylinder, a folding blade cylinder and/or a folding jaw cylinder of a downstream located folding apparatus 68, as may be seen in FIG. 9. In this way, it is possible to set the correct entry into the cylinders of the folding apparatus 68 for different widths of a web or a continuous web and/or positions.

To preset the printing press, it has been provided, in an advantageous embodiment, that a drive mechanism, which is not specifically represented, and which is used for driving the described movement of the former 06, 07, is in a signal connection with a control 10, or advantageously with the system S. The actual position of the former 06, 07 is compared by the use of production data, such as, for example, by the width of the web or partial web with a position which is or which can be preset for this production. If required, an appropriate movement is initiated by the use of actuating commands to the drive mechanism involved. The former 06, 07, or the former tip must be appropriately positioned, based on the width of the web, the partial web or the continuous web. For example, the former 06, 07 is positioned in such a way that, for each web width, the folded continuous web reaches the folding apparatus 68, or its folding devices, in a suitable manner, such as, for example, centered on the shell face of the following cylinder. Presetting values can be stored in the form of tables for the various production runs, or a calculation takes place in the system on the basis of the web paths resulting from the web widths and the lateral offset.

The above-described web processing tools are, individually or in groups, a component of a machine which works on a web and/or which processes a web, such as, for example, a printing press (FIG. 9), and in particular a web-fed rotary printing press for use in imprinting one or several webs B. For example, the web-fed rotary printing press has several units 61, 62, 63, 64, 65, 66, 67, 68, 69 for supplying, for imprinting and for further processing a web or webs. The web B to be imprinted, and in particular a paper web B, is unwound by the use of a roll unwinding device 61, for example, before it is fed to one or to several printing units 63 by a draw-in device 62. Further printing units 63 can be provided in addition to the printing units 63 which are normally provided for multi-color printing, such as, for example, four units for multi-color printing), which further printing units 63 then can, for example, be employed alternatingly by one or by several of the remaining printing units 63 for flying printing forme change. The printing units 63 can also be partially embodied, positioned vertically above each other, as bridge printing units 63 or as nine or ten cylinder satellite printing units.

In one embodiment, a varnishing unit 64 can be provided in the web path.

Following imprinting and, if performed, varnishing, the web B runs, for example, through a dryer 65 and, if needed, is cooled again in a cooling unit 66, if the drying in dryer 65 was performed thermally. Downstream of the dryer 65, at least one further conditioning unit, which is not specifically represented in FIG. 9, and which may be a coating device and/or a re-wetting device, for example, can be provided in, or following the cooling unit 66. Following cooling and/or conditioning, the web B can be conducted via a superstructure 67 to a folding apparatus 68. The superstructure 67 may have a silicon unit, which is not specifically represented in FIG. 9, the longitudinal cutting arrangement 71, and a turning device 72, or turning bar unit 72, having at least one turning bar deck, as well as a former unit with the former(s) 06, 07. The silicon unit can also be arranged upstream of the superstructure 67, such as, for example, in the area of the cooling unit 66. Furthermore, the superstructure 67 can have a perforating unit, which is also not specifically represented in FIG. 9, a gluing unit, a numbering unit and/or a plow folding device. After passing through the superstructure 67, the web B, or the partial webs B1, B2, are conducted into the folding apparatus 68.

In an advantageous embodiment of the present invention, the printing press additionally has a separate transverse cutting device 69, such as, for example, a so-called planographic delivery device 69, in which a web B which, for example, had not been conducted through the folding apparatus 68, is cut into format sheets and, if required, is stacked or delivered.

Preferably, the system S, which is used for presetting the processing tools or units, is assigned to the printing press, such as, for example, as an additional program in a printing press control device and/or a planning system, which control device or system is in a logical signal connection with one or with several of the above mentioned processing tools, or units 61, 62, 63, 64, 65, 66, 67, 68, 69, and in particular with the units 61, 63, 67.

In an advantageous further development of the present invention, the elements of the roll changer 61 also fall under the above mentioned processing tools. For example, it is also advantageous, in case of production changes by one or by several of the above mentioned web processing tools, to simultaneously perform a lateral displacement of the roll arms for matching the new width and/or position of the web. The displacement of the roll is useful, for example, if a partial web is intended to be moved through the printing press in a different alignment than had previously been done.

It is also advantageous if a lateral adjustment of cutting register and/or color register measurement members, such as, for example, sensors, and/or a web edge regulation device 57, are simultaneously matched to the new production run in the axial direction. It is further advantageous if an adjustment of the contact pressure rollers against the traction roller underneath the former takes place.

In the area of the folding apparatus, an adjustment of the paddle wheel in the outlet, an adjustment of the gluing nozzles of a possibly provided gluing unit, an adjustment of the second longitudinal fold, and/or an adjustment of the perforating cutter for longitudinal perforation, can take place simultaneously, for example, for different adjustments.

In the above context, in the wider sense, the term web processing tools is also understood to include sensing and actuating devices, which have an effect on the detection and on the influencing of the running of a web, or partial web, or continuous web.

When presetting the printing press, such as, for example, at the start of a production run, the system S receives data that is relevant to the planned production run from a product planning system, from a print preparation stage, from the printing press operator himself, and/or from an existing imposition pattern for use in presetting. The imposition pattern contains the paths of the webs or of the partial webs which are intended for the planned production run, as well as the provision of the forme cylinders with the print pages, as well as the ink colors of the different printing groups. Information regarding the web width and/or the intended lateral position of the web can then be entered by the printing press operator, or can be obtained from a machine control device, the roll changer 61 itself, a logistics system, or from a product planning system.

To position the longitudinal cutting arrangement 71 and/or the roll changer 61, the information regarding the planned web width and/or the web position, for example, is used to position the former 06, 07 for the partial web width. The information regarding the intended paths of the web, or the partial webs, is processed for positioning the turning bars 37, 38 and, if required, for also positioning a linear registration device 58 that is assigned to the partial web in the superstructure 67. In a further development, it is possible to perform the presetting of colorimeters in the printing groups, for example, by using data from the print preparation and/or the imposition pattern, such as color densities, deployment, etc.

In an advantageous first variation of the simplest preferred embodiment of the printing press in accordance with the present invention, at least the longitudinal cutting arrangement 71 with regard to the web to be processed, is preset by the system S. In this case, the roll changer 61 can, if desired without "external" presetting, always be regulated to the center by its own inner control circuit. In a further development, in this process the former 06, 07, or the former unit 73, are also positioned, laterally and/or in the paper running direction by the system S.

In a second variation of the printing press in accordance with the present invention, at least the positioning, laterally and/or in the paper running direction, of the former 06, 07, or of the former unit 73, is preset by the system S or by the control device 10. It is then possible to position, together with the former 06, 07, a cutter 05 and/or a downstream arranged driven shaft 30 and to connect them with the former. In this case, the roll changer can, again if desired without "external" presetting, always be regulated to the center by use of its own inner control circuit.

In a well-appointed embodiment of the present invention, presetting, for positioning the former 08, 07 and the turning bar unit 72, as well as possibly also the roll changer 61, is performed by the system S.

In an alternative embodiment, presetting of the longitudinal cutting arrangement 71, or at least one cutter 28, 32, and of the turning bar unit 72, as well as possibly also of the roll changer 61, is performed by the system S. In a greatly automated embodiment, the former 06, 07 is also positioned.

In addition to the above-mentioned three enlargement stages, presetting of the calorimeters and/or of the stripper elements can also advantageously take place by use of the system S.

Basically, depending on the need and the degree of automation, a selection of units or of partial units which are to be preset and which differ from what was mentioned above, can be provided. Thus, for example, presetting can be directed in one embodiment only to setting the calorimeters and the longitudinal cutting arrangement 71. In another embodiment, all of the units or the partial units which are provided for web guidance and for cutting, and in particular those of the superstructure 67, can be intended for presetting.

In addition to the above mentioned enlargement stages and their variations, it is advantageously possible to perform presetting of cutting register and/or of color registration measurement members 56, such as, for example, sensors, and/or a web edge regulation device 57, in the axial direction, in view of a new production run, and/or an adjustment of the contact pressure roller 35 or rollers against the traction roller 30 in response to an expected thickness of the continuous web underneath the former 06, 07.

The drive mechanisms 11, 23, 34, 49 of the above-mentioned processing tools, or at least those of the processing tools intended for presetting, are preferably structured to be remote-controlled, or are remote-controlled by the system S or by the control device 10. In contrast to actuating members which are operated manually or which can be operated only at the position, presetting is possible, in this way, in one or in several of the previously mentioned embodiments, and variations thereof, in an easy and rapid manner via the system S or via the control console.

The system S can be embodied as a control unit S, which includes a user interface for input and/or an interface for reading-in, from the printing press control device, from a production system and/or from a print preparation stage, of at least a width and/or a web path of a web to be processed. A computer, for use in determining a desired position of the units, partial units or processing tools to be preset, such as the roll changer 61, the longitudinal cutting arrangement 71, the turning bar 37, 38, a linear registration device 58 assigned to the partial web, and/or the formers 06, 07, on the basis of the web width is also part of the system S. Also included are drivers for triggering the associated actuating members for setting the respectively determined desired position.

While preferred embodiments of a device for transmitting and conveying a strip of material and methods for regulating these devices, in accordance with the present invention, have been set forth fully and completely hereinabove, it will be apparent to one of skill in the art that various changes in, for example, the specific structure of the printing units, roll changers and the like could be made without departing from the true spirit and scope of the present invention which is accordingly to be limited only by the following claims.

What is claimed is:

1. A device for processing a web in a web processing machine comprising:

a web cutter;

a web cutter drive mechanism adapted to move said web cutter transversely to a path of travel of a web in said web processing machine;

a web former located after, in said path of travel of a web in said web processing machine, said web cutter;

at least one actuating member including a former drive mechanism which is independent of said web cutter drive mechanism and which is adapted to move said-former transversely to said path of web travel;

a turning bar unit with at least one turning bar, said turning bar unit being located before, in said direction of web travel, said former, and after said web cutter, said turning bar unit being movable transversely to said path of web travel;

a separate drive mechanism for said at least one turning bar; and a control system including a computer in functional connection with each said web cutter drive mechanism, said former drive mechanism and said turning bar drive mechanism, said computer in said control system being adapted to control each of said web cutter drive mechanism, said former drive mechanism and said turning bar drive mechanism to preset each of said web cutter, said former and said turning bar before the start of a production run of said device for processing a web in response to the reading-in of print preparation stage data into said computer, which print preparation stage data is supplied to said computer in said control system from a print preparation stage.

2. The device of claim 1 further including a common stand for said web cutter and said web former and being movable by said former drive mechanism.

3. The device of claim 1 further including at least first and second web formers and means supporting at least one of said web formers for said movement transversely to said path of web travel.

4. The device of claim 1 further including a cylinder in engagement with said web, and at least two web processing tools engageable with said cylinder, at least one of said web processing tools being movable transversely to said direction of web travel.

5. The device of claim 4 wherein said two web processing tools are selected from interceptor rollers and traction rollers.

6. The device of claim 1 wherein said web cutter is a longitudinal web cutter.

7. The device of claim 1 wherein said web cutter is an interval web cutter.

8. The device of claim 1 further including a roll changer with at least one transversely movable roll arm.

9. The device of claim 1 further including at least one transversely movable sensor adapted to provide cutting registration.

10. The device of claim 1 further including at least one transversely movable sensor adapted to provide color registration.

11. The device of claim 1 further including at least one transversely movable web edge regulating device.

12. The device of claim 1 further including a transversely movable device adapted to form a second longitudinal fold in said web.

13. The device of claim 1 further including at least one transversely movable web longitudinal perforation device.

14. The device of claim 1 wherein said at least one actuating member includes a rotatable threaded spindle.

15. The device of claim 14 further including a sliding block in engagement with said threaded spindle.

16. The device of claim 14 further including a plurality of displaceable web processing tools in engagement with said threaded spindle.

17. The device of claim 16 wherein said threaded spindle includes threaded sections of different thread gradients.

18. The device of claim 14 further including an electric drive motor adapted to rotate said threaded spindle and being controlled by said computer in said control system.

19. The device of claim 1 further including a grooved roller adapted to be movable with said web former.

20. A device for processing a web in a web-fed rotary printing press comprising:

a longitudinal cutting arrangement including at least first and second web Cutters;

a cutting arrangement drive mechanism for moving said at least first and second web cutters transversely to a path of travel of a web in said web-fed rotary printing press;

a former located after, in said path of travel of a web in said web-fed rotary printing press, said longitudinal cutting arrangement;

a former drive mechanism separate from said cutting arrangement drive mechanism and adapted to move said former transversely to said path of web travel;

means supporting said first and second web cutters spaced transversely apart from each other and movable in opposite directions with respect to each other by said cutting arrangement drive mechanism, said culling arrangement drive mechanism being mechanically independent of said former drive mechanism; and a control system including a computer in functional connection with said former drive mechanism and with said cuffing arrangement drive mechanism, said computer in said control system being adapted to control each of said cutting arrangement drive mechanism and said former drive mechanism to preset each of said longitudinal cutting arrangement and said former before the start of a production run of said device for processing and in response to the reading-in of print preparation stage data into said computer, which print preparation stage data is supplied to said computer in said control system from a print preparation stage.

21. The device of claim 20 wherein said computer in said control system is adapted to operate said drive mechanism in response to a position of said web.

* * * * *

UNITED STATES PATENT AND TRADEMARK OFFICE

CERTIFICATE OF CORRECTION

PATENT NO. : 7,523,925 B2
APPLICATION NO. : 10/540209
DATED : April 28, 2009
INVENTOR(S) : Burkard Otto Herbert and Stefan Wander It is certified that error appears in the above-identified patent and that said Letters Patent is hereby corrected as shown below:

Column 16, Claim 20, Line 18, after "web", change "Cutters" to -- cutters --;
Column 16, Claim 20, Line 32, after "said", change "culling" to -- cutting --; and
Column 16, Claim 20, Line 37, before "arrangement", change "cuffing" to -- cutting --.

Signed and Sealed this

Fourteenth Day of July, 2009

JOHN DOLL
*Acting Director of the United States Patent and Trademark Office*